United States Patent [19]

Belmont

[11] Patent Number: 4,557,013

[45] Date of Patent: Dec. 10, 1985

[54] VACUUM COUPLED SQUEEGEE ATTACHMENT

[76] Inventor: Lee Belmont, P.O. Box 171, West Linn, Oreg. 97068

[21] Appl. No.: 621,622

[22] Filed: Jun. 18, 1984

[51] Int. Cl.[4] ..... A47L 9/06

[52] U.S. Cl. ..... 15/401; 15/419

[58] Field of Search ..... 15/401, 419, 320

[56] References Cited

U.S. PATENT DOCUMENTS

| | | | |
|---|---|---|---|
| 1,651,894 | 12/1927 | Kent et al. | 15/419 |
| 1,982,345 | 11/1934 | Kirby . | |
| 2,176,139 | 10/1939 | Lofgren | 15/419 X |
| 2,631,326 | 3/1953 | Smith | 15/419 X |
| 2,893,046 | 7/1959 | Thompson | 15/325 |
| 3,079,623 | 3/1963 | Congdon | 15/401 X |
| 3,210,792 | 10/1965 | Sassano | 15/401 |
| 3,584,330 | 6/1971 | Wallin et al. | 15/401 X |

*Primary Examiner*—Chris K. Moore

*Attorney, Agent, or Firm*—Chernoff, Vilhauer, McClung, Birdwell & Stenzel

[57] ABSTRACT

A squeegee attachment for a wet/dry vacuum cleaner having an elongate cleaning head and a deformable blade inserted into the head such that the blade barely extends past a lower portion of the cleaning head which forms part of a suction part, the blade effectively blocking the part in its nondeformed position and opening the part in its deformed position so as to create a maximum amount of suction at the surface to be cleaned.

9 Claims, 3 Drawing Figures

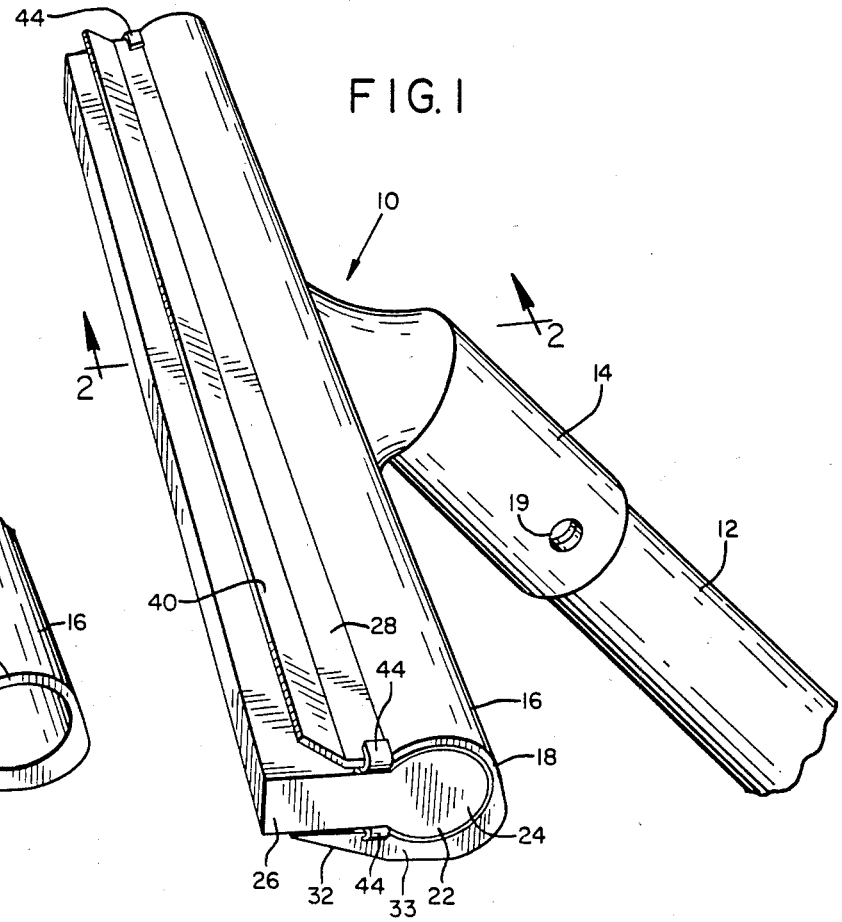
FIG. 1
FIG. 3
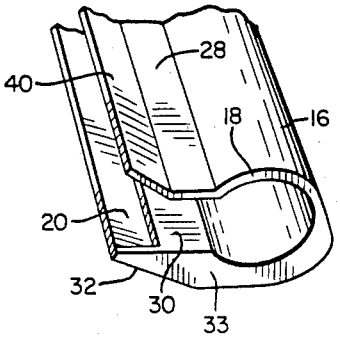
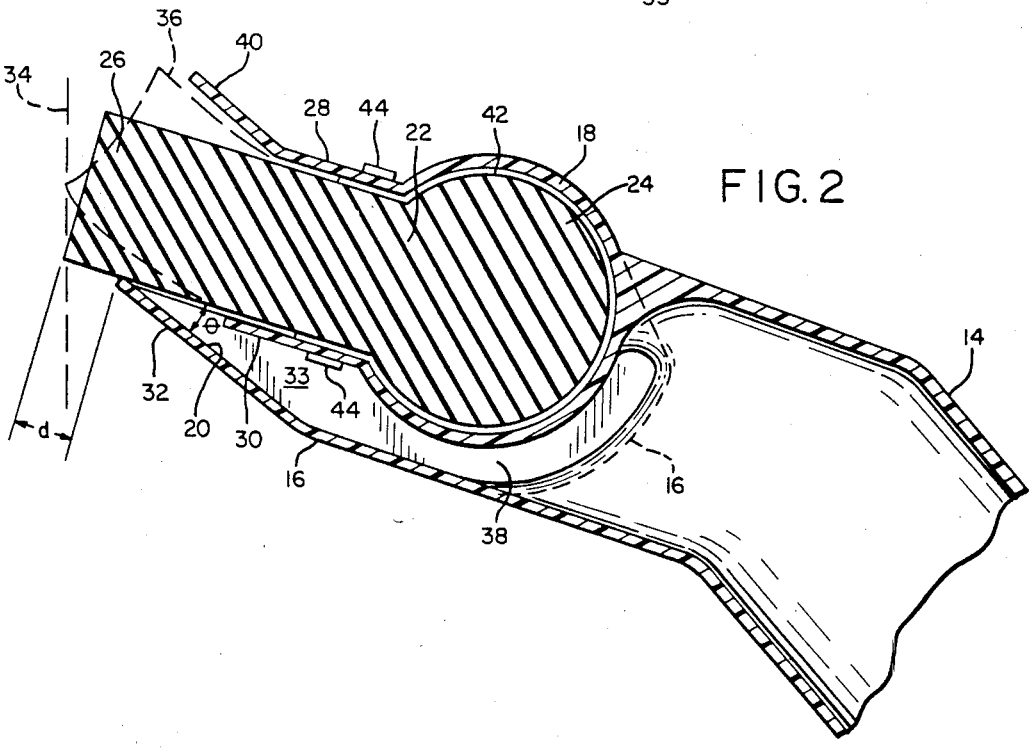
FIG. 2

VACUUM COUPLED SQUEEGEE ATTACHMENT

BACKGROUND OF THE INVENTION

The following invention relates to a squeegee attachment for a vacuum cleaner of the wet/dry variety for removing dirt and foreign matter from planar surfaces such as windows.

Squeegee blades are implements for use in window washing or the cleaning of planar surfaces. A squeegee blade is a thin, deformable blade usually made of rubber, which is held in an elongate holder and drawn across the window by a handle connected at an oblique angle to the holder. The handle can either be grasped by the hand or fitted with extension rods for reaching high windows. Usually in cleaning large windows a cleaning fluid is first applied to the surface of the glass with an applicator such as a sponge. The squeegee blade then is drawn across the surface of the glass removing the cleaning fluid along with the dirt. While this method is useful for cleaning most of the surface of the glass, a problem exists near the bottom of the glass where all the dirt and cleaning fluid collects because there is no collection point or place for the fluid to flow from which it can be easily removed. The fluid and dirt simply collect at the bottom of the glass in the windowsill, and there is no effective means of removing it from this location.

In the past, rug and floor cleaners have included cleaning attachments for a wet/dry vacuum cleaner which included brushes and/or blades to loosen the dirt. An example of such a device is shown in Thompson U.S. Pat. No. 2,893,046. The Thompson patent discloses a cleaning attachment having a pivotallymounted blade which moves back and forth within a suction channel in the head of the cleaning device for dislodging dirt or other foreign matter. Several problems are inherent in the structure of the Thompson device. First, the mounting of the squeegee blade in the handle does not provide for the most efficient removal of water and/or cleaning fluid. Second, the blade extends too far forwardly of the head for creating efficient suction at the juncture of the blade and the floor where the water collects, and third, the blade is mounted so as to pivot back and forth within the vacuum channel. This mounting does not provide for enough suction either on the push or the pull stroke because in neither stroke is the suction channel close enough to the place where the water collects to provide efficient suction.

A similar design is shown in Kirby U.S. Pat. No. 1,982,345. The device of the Kirby patent includes a squeegee centrally mounted within an elongate suction chamber in the forward end of the cleaning attachment. As in the Thompson device, the squeegee in the Kirby patent is intended to be operative both on the pull and on the push stroke but, as mentioned above, the reciprocating blade action results in too little suction for efficient collecting of the water. The Kirby device also has a brush sandwiched between two squeegee blades that projects forwardly of the blades thus hindering any suction-type seal that could be made between the blade, the glass and the intake or suction port.

The reason for this inability to create efficient suction in a device having a pivoting blade which is intended to remove fluid on both the forward and reverse stroke, is that the effective area of the suction port is too large. The maximum amount of suction will occur in a region near the point of contact between the blade and the glass or planar surface to be cleaned. Efficient suction will not occur, however, if the exterior walls of the attachment forming the suction channel are spread too broadly over and too far away from this point of contact.

Another problem that occurs in both of the aforementioned devices, and also described in Congdon U.S. Pat. No. 3,079,623, is that the blade and the suction channel are oriented perpendicular to the surface to be cleaned. Especially on the downstroke, the fluid must be drawn off the glass at right angles to the normal direction of flow which would be downward due to the force of gravity. Thus a good deal of the fluid escapes and is not drawn up into the vacuum channel. Such an orientation is necessary, however, if one wishes to provide for the ability of the device to clean both on the upstroke and on the downstroke. While theoretically such a device might appear to be more efficient, it is in reality inefficient and leads to smearing of the cleaning fluid or water across the window.

SUMMARY OF THE INVENTION

The present invention effectively solves the problem of smearing and is capable of efficiently clearing the surface to be cleaned of all water or cleaning fluid as well as foreign matter. According to the invention, an elongate cleaning head is provided having a squeegee blade which extends the length of the head, and a suction port located directly underneath the squeegee blade. The cleaning head is connected to a handle which also includes a rear exhaust aperture for the water and dirt to be sucked into a conduit connected to a wet/dry vacuum cleaner.

The squeegee blade is inserted into a retainer located inside the cleaning head. The retainer holds the blade at an oblique angle to the suction port so that when the blade is straight, prior to drawing the device across a window, the blade effectively blocks the suction port. When the blade is drawn across the window, it deforms, bending upwards until it meets a portion of the cleaning head which serves as a stop. When the blade is thusly bent, the suction port opens, and, as the device is drawn across a window, an area of maximum suction is created in the region bounded by the blade, the window and the lower lip of the cleaning head (which also forms the lower boundary of the suction port). The blade extends just barely past this lower lip portion of the suction port so that the port is very close to the glass or planar surface when the blade is drawn across it. Thus, nearly all of the water collected by the blade on its downward stroke is sucked into the suction port. The port is angled obliquely with respect to the blade and an upper portion of the attachment, which serves as a stop for the blade, maintains the blade in its bent position substantially parallel to the lower suction port surface. Thus, the blade is allowed to flex, opening up the port, but not to flex too much so as to destroy the cleaning efficiency of the blade or to allow water to escape from the intake area of the suction port.

The attachment has a retainer portion for the blade which includes a partially circular cross section into which the rear portion of the blade, which is also circular in cross section, is inserted. Rounded clips encircling this portion of the blade which function as frictional shims may be inserted into the retainer portion of the attachment to keep the blade firmly held within. An aperture may be located in the handle which is selectively operable by the user so that when the blade is straight and is effectively blocking the suction port, no load is created on the vacuum motor. The aperture provides a source of air which may be sucked into the connecting conduit through an alternate path. When in use, prior to drawing the blade across a pane of glass, the aperture is covered so as to create a maximum amount of suction at the suction port.

It is a primary object of this invention to provide a squeegee attachment for a wet/dry vacuum cleaner which removes all fluid and dirt from a planar surface to be cleaned.

It is further object of this invention to provide a squeegee attachment coupled to a vacuum cleaner which is capable of cleaning planar surfaces without smearing.

Yet a further object of this invention is to provide a vacuum coupled squeegee blade which creates a maximum amount of suction for the dirt and cleaning fluid at the squeegee blade/planar surface interface.

A still further object of this invention is to provide a squeegee blade capable of cleaning windows without the attendant problem of cleaning fluid or water collecting on the lower windowsill.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a perspective view of a squeegee attachment for a wet/dry vacuum cleaner, including a squeegee blade inserted therein.

FIG. 2 is a side view taken along line 2—2 of FIG. 1 showing in phantom line the orientation of the squeegee blade when the device is drawn across a window or other planar surface.

FIG. 3 is a partial perspective view of the squeegee blade attachment of FIG. 1 without the blade inserted therein.

DETAILED DESCRIPTION OF THE INVENTION

Referring to FIG. 1, a squeegee attachment 10 is connected to a conduit 12 which is in turn connected to the intake port of a wet/dry vacuum cleaner (not shown). The vacuum cleaner can be of any conventional configuration but should be capable of handling fluids such as water or cleaning solution. The attachment 10 includes a handle portion 14 and a cleaning head portion 16.

The handle 14 also includes a selectively-operable aperture 19 which may, for example, be a hole in the cleaning handle which may be covered with the hand or thumb. The cleaning head 16 includes a squeegee blade retainer portion 18 and a suction port 20.

A squeegee blade 22 may be slidably inserted into retainer portion 18. The squeegee blade 22 may be of any conventional configuration, and such configurations commonly include a rounded body portion 24 which resembles an elongate cylinder and a flat, rectangular blade portion 26. The blade portion 26 is resilient and deformable.

The retainer portion of the cleaning head includes an upper surface 28 and a lower surface 30 which also forms an interior baffle defining the upper boundary for the suction port 20. The inner baffle 30 is substantially parallel to at least a portion of the upper retaining surface 28 so as to cause blade 22 to extend at a predetermined angle away from the cleaning head when the blade is in a straight, or nondeformed, position. The cleaning head has a lower surface 32 that is angled obliquely with respect to the blade 22 in its straight position. This angle is indicated as "$\theta$" in FIG. 2. Thus, the suction port is defined as the gap between surface 32 and inner baffle 30. The blade 22, while in its straight or nondeformed position effectively covers the gap between these two surfaces and blocks the suction port 20.

In order to further maximize suction within port 20, end covers 33 connect lower surface 32 with inner baffle 30 at both ends of cleaning head 16. Thus no air is drawn in from the side of cleaning head 16 which would otherwise diminish the suction available within suction port 20. End covers 33 are shaped to cover only the sides of cleaning head 16 bounded by the cross section (as viewed along line 2—2) of baffle 30 and lower surface 32 to permit insertion and removal of blade 22.

When the cleaning head 16 is drawn across a glass or other planar surface, indicated generally by the vertical dashed line 34 in FIG. 2, the rectangular portion 26 of blade 22 is deformed or bent in an upward direction as indicated by the generally rectangular dashed lines at 36 in FIG. 2. Deforming the blade 22 in this manner causes suction port 20 to open and permits water, dirt or debris collected at the boundary between the glass 34 and deformed blade 36 to be drawn into suction port 20 through a hollow cleaning head channel 38 and into conduit 12. The upper surface 28 of the blade retainer 18 includes a bent or angled portion 40. This portion serves as a stop to prevent rectangular blade portion 26 from bending any more than is necessary for creating the most efficient configuration for suction port 20. A maximum amount of suction on the underside of the bent portion of the blade 26 will be attained if portion 26 in its bent position is substantially parallel to lower suction port surface 32. Thus, the upper stop portion 40 of retainer 18 is substantially parallel to surface 32.

In order to create an effective vacuum coupling between the surface of the glass 34 and suction port 20, blade 22 is dimensioned so that the tip of the blade barely extends past the end of the suction port, that is, forwardly toward the glass from lower surface 32. In actual practice, it has been discovered that the blade tip length indicated as dimension "d" between the double-dashed lines in FIG. 2, should be between $\frac{1}{4}$ inch and $\frac{1}{2}$ inch for maximum effectiveness. A length of $\frac{3}{8}$ inch has been found to be optimum. It will be appreciated that, when the blade is dimensioned in this manner, the end of lower surface 32 is very close to the surface of the glass 34 when the blade is drawn across it. With these tolerances, the path of least resistance for the water and/or cleaning fluid and accumulated debris is into the suction port. It has also been discovered that the angle at which lower surface 32 meets blade section 26, angle $\theta$, should be between 15° and 45° with an angle of approximately 30° being optimum. This angle allows the water and dirt collected at the interface of blade portion 26 and glass 34 to have a downward component of flow which takes advantage of the force of gravity acting upon the water.

The blade may be held in place by interior shims 42. These shims generally have the shape of the cylindrical portion of the blade 24 and part of its rectangular portion 26. The shims are simply inserted at both ends of the retainer portion 18 of the cleaning head 16. A set of clips 44 holds the shims in place.

The handle 14 includes an aperture 19 which is selectively operable. This may be accomplished, for example, by simply placing a digit or thumb across the aperture when it is to be closed and removing the same when the aperture is to be opened. Since the blade 22 effectively covers suction port 20 when the blade is in its straight or nondeformed position, a substantial load is placed on the vacuum cleaner motor (not shown). Aperture 19 thus provides a relief valve for this condition. When the attachment is in use, however, and the blade is drawn across a glass, the aperture should be covered so as to create a maximum amount of suction at suction port 20.

The terms and expressions which have been employed in the foregoing specification are used therein as terms of description and not of limitation, and there is no intention, in the use of such terms and expressions, of excluding equivalent sof the features shown and described or portions thereof, it being recognized that the scope of the invention is defined and limited only by the claims which follow.

What is claimed is:

1. A Vacuum coupled squeegee for the removal of dirt and foreign matter from a planar surface comprising:

(a) vacuum-producing means for creating suction in a conduit;

(b) an elongate cleaning attachment for said conduit having:

(i) a rear aperture connected to said conduit, (ii) a front suction port extending substantially the length of said attachment, (iii) a holder for a deformable blade disposed adjacent said port; and (c) a deformable blade insertable into said holder covering said port and extending slightly forwardly of said port, such that when said blade is drawn across said planar surface, said blade deforms, opening said port so as to create a region of suction in the area bounded by said blade, said surface and said port.

2. The combination as claimed in claim 1 wherein said elongate attachment has a top surface and a bottom surface and includes an inner baffle between said surfaces, said top surface and said inner baffle forming said blade holder, and said baffle and said lower surface forming said suction port.

3. The combination as claimed in claim 2 wherein said baffle is parallel to a first portion of said top surface enclosing said blade therebetween such that said blade is oriented in a predetermined direction and wherein said bottom surface is oriented at a predetermined angle with respect to said blade direction, said angle lying in a range between 15° and 45°.

4. The combination claimed in claim 3 wherein said top surface includes a second forward portion substantially parallel to said bottom surface such that when said blade is drawn across said surface, said blade is momentarily deformed to be substantially parallel both to said second forward portion and to said lower surface.

5. The combination as claimed in claim 4 wherein said blade extends forwardly of the end of said lower surface for more than $\frac{1}{4}$ inch but less than $\frac{1}{2}$ inch.

6. A squeegee attachment for a wet/dry vacuum cleaner comprising:

(a) a handle portion coupled to said vacuum cleaner;

(b) an elongate cleaning head having a frontal suction intake port;

(c) a deformable blade having a bent and a straight position; and (d) means for retaining said blade in said attachment such that said blade barely extends forwardly of said port and is oriented at an angle with respect to said port so as to block said port when said blade is in said straight position and to open said port when said blade is in said bent position.

7. The attachment of claim 6 wherein said port is partially defined by a lower surface of said cleaning head and wherein said retaining means includes stop means for limiting the deformation of said blade in its bent position, said stop means and said lower surface lying in planes substantially parallel to one another.

8. The attachment of claim 7 further including selectively operable aperture means located in said handle portion for decreasing the suction at said port when said blade is in its straight position and for increasing the suction at said port when said blade is in its bent position.

9. The attachment of claim 7 further including an inner baffle defining both a lower portion of said retaining means and an upper boundary of said suction port, said baffle oriented obliquely with respect to said lower surface and substantially parallel to said blade in its straight position.

* * * * *

UNITED STATES PATENT AND TRADEMARK OFFICE

CERTIFICATE OF CORRECTION

PATENT NO. : 4,557,013

DATED : December 10, 1985

INVENTOR(S) : BELMONT, LEE

It is certified that error appears in the above-identified patent and that said Letters Patent is hereby corrected as shown below:

Column 1, line 35:
Change "privotallymounted" to --pivotally mounted--

Column 5, line 21:
Change "equivalent sof" to --equivalents of--

Column 5, line 27:
Change "Vacuum" to --vacuum--

Signed and Sealed this

*Fifteenth* Day of *July 1986*

[SEAL]

*Attest:*

DONALD J. QUIGG

*Attesting Officer*

*Commissioner of Patents and Trademarks*